US010465517B2

(12) United States Patent
Ladrón De Guevara

(10) Patent No.: US 10,465,517 B2
(45) Date of Patent: Nov. 5, 2019

(54) ARTIFICIAL LIFTING SYSTEM WITH A PROGRESSIVE CAVITY PUMP DRIVEN BY A PROGRESSIVE CAVITY MOTOR FOR HYDROCARBON EXTRACTION

(71) Applicant: SERINPET LTDA. REPRESENTACIONES Y SERVICIOS DE PETROLEOS, Cota (CO)

(72) Inventor: Alejandro Ladrón De Guevara, Cota (CO)

( * ) Notice: Subject to any disclaimer, the term of this patent is extended or adjusted under 35 U.S.C. 154(b) by 0 days.

(21) Appl. No.: 14/655,932

(22) PCT Filed: Dec. 24, 2013

(86) PCT No.: PCT/IB2013/061306
§ 371 (c)(1),
(2) Date: Nov. 5, 2015

(87) PCT Pub. No.: WO2014/102717
PCT Pub. Date: Jul. 3, 2014

(65) Prior Publication Data

US 2016/0097280 A1 Apr. 7, 2016

(30) Foreign Application Priority Data

Dec. 26, 2012 (CO) ..... 12233506

(51) Int. Cl.

| | |
|---|---|
| ***F01C 1/10*** | (2006.01) |
| ***E21B 43/12*** | (2006.01) |
| ***F04C 2/107*** | (2006.01) |
| ***F04C 11/00*** | (2006.01) |
| ***F04C 13/00*** | (2006.01) |
| ***F04C 15/06*** | (2006.01) |

(52) U.S. Cl.
CPC ..... *F01C 1/101* (2013.01); *E21B 43/129* (2013.01); *F04C 2/1071* (2013.01); *F04C 11/001* (2013.01); *F04C 13/008* (2013.01); *F04C 15/06* (2013.01)

(58) Field of Classification Search
CPC .. E21B 43/126; E21B 17/1078; E21B 43/129; E21B 17/18; E21B 43/128; E21B 43/38; E21B 33/122; E21B 43/00; E21B 43/14; E21B 43/16; F04C 2240/70; F04C 2/1075
USPC ..... 418/48
See application file for complete search history.

(56) References Cited

U.S. PATENT DOCUMENTS

| | | | | |
|---|---|---|---|---|
| 6,454,010 | B1 * | 9/2002 | Thomas | E21B 17/18 166/105 |
| 2009/0223665 | A1 * | 9/2009 | Colley, III | E21B 43/26 166/280.1 |
| 2012/0034120 | A1 * | 2/2012 | Del Pozo | E21B 17/1078 418/48 |

* cited by examiner

*Primary Examiner* — Audrey K Bradley
*Assistant Examiner* — Anthony Ayala Delgado
(74) *Attorney, Agent, or Firm* — Cotman IP Law Group, APLC

(57) ABSTRACT

The invention relates to an artificial lifting system comprising a progressive cavity motor for hydrocarbon's extraction. In the invention's system a pump injects a fluid stored in the surface to the progressive cavity motor, located in the basement; the rotation that occurs by the passage of fluid is transmitted to a progressive cavity pump such that the hydrocarbon is pushed toward the surface.

10 Claims, 4 Drawing Sheets

ARTIFICIAL LIFTING SYSTEM WITH A PROGRESSIVE CAVITY PUMP DRIVEN BY A PROGRESSIVE CAVITY MOTOR FOR HYDROCARBON EXTRACTION

TECHNICAL FIELD

This invention relates to an artificial lifting system that has a progressive cavity motor that is installed, in turn, at the bottom of an oil well and that allows generating speed and torque required to move a progressive cavity pump and to perform the hydrocarbon extraction.

This invention is directly related to the hydrocarbon sector, specifically for oil extraction applied technologies. Its applicability is specific in oil wells, mechanical pumping, electro submersible systems and progressive cavity pumps, that are mechanically connected to a surface speed reducer by a rod string as an artificial lifting system of the hydrocarbons that are located in the subsurface.

STATE OF THE ART

In hydrocarbons sector it is known the use of electric or hydraulic heads in the surface as well as a bottom electric motors. This equipment generates the speed and the torque required for the progressive cavity pumps, which are located at the bottom of oil wells, for the extraction of hydrocarbons.

In the case of progressive cavity pumps, electric or hydraulic engines are used in the surface attached to a reduction gearbox that comprises the oil well head. The reducer rotates the rod strings, which in turn rotates the progressive cavity pump. This system requires the rods string to act as an element of power transmission between the head surface and the progressive cavity pump located at the bottom of the oil well. As the system requires the use of rods there is an additional energy waste due to rods friction with the fluid and the pipeline. The rods are fatigued with work by constant exposure to tension, torsion and friction. This wear produces a break or disconnection of rods interrupting oil extraction. In the case of electro submersible progressive cavity pumps they use very long and small diameter motors that works at high voltages (4.160V) and high revolutions per minute (3.600 RPM). This system requires a special cable that transmits electric power from the surface of a superficial transformer to the bottom of the well, where the electric motor is located. Therefore, the electric energy losses occur as heat all along the cable. Due to the bottom electric motors high speed, the artificial lifting system is only applicable in high-flow or high production wells.

Considering the highest costs, the complexity and the low reliability inherent in the use of the rods strings and electrical wires (such as power transmission elements between the surface head and the pumps or the bottom electric motors) this invention delivers an artificial lifting system with a progressive cavity motor in the bottom of the well for oil extraction. These motors are driven by injected fluid (water or oil) sent from the surface. As the progressive cavity motor is in the bottom of the well, the connection between the progressive cavity motor and the progressive cavity pump is a flexible axis with a length less than 6 m. Hence, this implies that reliability of the system increases for the extraction of hydrocarbons. Besides, once the fluid traverse the progressive cavity motor, it returns to the surface, due to communicating vessels effect and a decrease in energy consumption required for the extraction of hydrocarbons is achieved.

DESCRIPTION OF THE INVENTION

Technical Problem

In hydrocarbons sector it is known the use of electric or hydraulic heads in the surface as well as a bottom electric motors. This equipment generates the speed and the torque required for the progressive cavity pumps, which are located at the bottom of oil wells, for the extraction of hydrocarbons.

In the case of progressive cavity pumps, electric or hydraulic engines are used in the surface attached to a reduction gearbox that comprises the oil well head. The reducer rotates the rod strings, which in turn rotates the progressive cavity pump. This system requires the rods string to act as an element of power transmission between the head surface and the progressive cavity pump located at the bottom of the well. As the system requires the use of rods there is an additional energy waste due to rods friction with the fluid and the pipeline. The rods are fatigued with work by constant exposure to tension, torsion and friction. This wear produces a break or disconnection of rods interrupting oil extraction. In the case of electro submersible progressive cavity pumps they use very long and small diameter motors that works at high voltages (4.160V) and high revolutions per minute (3.600 RPM). This system requires a special cable that transmits electric power from the surface of a superficial transformer to the bottom of the well, where the electric motor is located. Therefore, the electric energy losses occur as heat all along the cable. Due to the bottom electric motors high speed, the artificial lifting system is only applicable in high-flow or high production wells.

Considering the highest costs, the complexity and the low reliability inherent in the use of the rods strings and electrical wires (such as power transmission elements between the surface head and the pumps or the bottom electric motors) this invention delivers an artificial lifting system with a progressive cavity motor in the bottom of the well for oil extraction. These motors are driven by injected fluid (water or oil) sent from the surface. As the progressive cavity motor is in the bottom of the well, the connection between the progressive cavity motor and the progressive cavity pump is a flexible axis with a length less than 6 m. Hence, this implies that reliability of the system increases for the extraction of hydrocarbons. Besides, once the fluid traverse the progressive cavity motor, it returns to the surface, due to communicating vessels effect and a decrease in energy consumption required for the extraction of hydrocarbons is achieved.

Problem Solution

Considering the highest costs, the complexity and the low reliability inherent in the use of the rods strings and electrical wires (such as power transmission elements between the surface head and the pumps or the bottom electric motors) this invention delivers an artificial lifting system with a progressive cavity motor in the bottom of the well for oil extraction. These motors are driven by injected fluid (water or oil) sent from the surface. As the progressive cavity motor is in the bottom of the well, the connection between the progressive cavity motor and the progressive cavity pump is a flexible axis with a length less than 6 m. Hence, this implies that reliability of the system increases for the extraction of hydrocarbons. Besides, once the fluid traverse the progressive cavity motor, it returns to the surface, due to communicating vessels effect and a decrease in energy consumption required for the extraction of hydrocarbons is achieved.

Advantageous Effects of the Invention

As the progressive cavity motor is in the bottom of the well, the connection between the progressive cavity motor and the progressive cavity pump is a flexible axis with a length less than 6 m. Hence, this implies that reliability of the system increases for the extraction of hydrocarbons. Besides, once the fluid traverse the progressive cavity motor, it returns to the surface, due to communicating vessels effect and a decrease in energy consumption required for the extraction of hydrocarbons is achieved.

REFERENCES LIST

Figure 1:
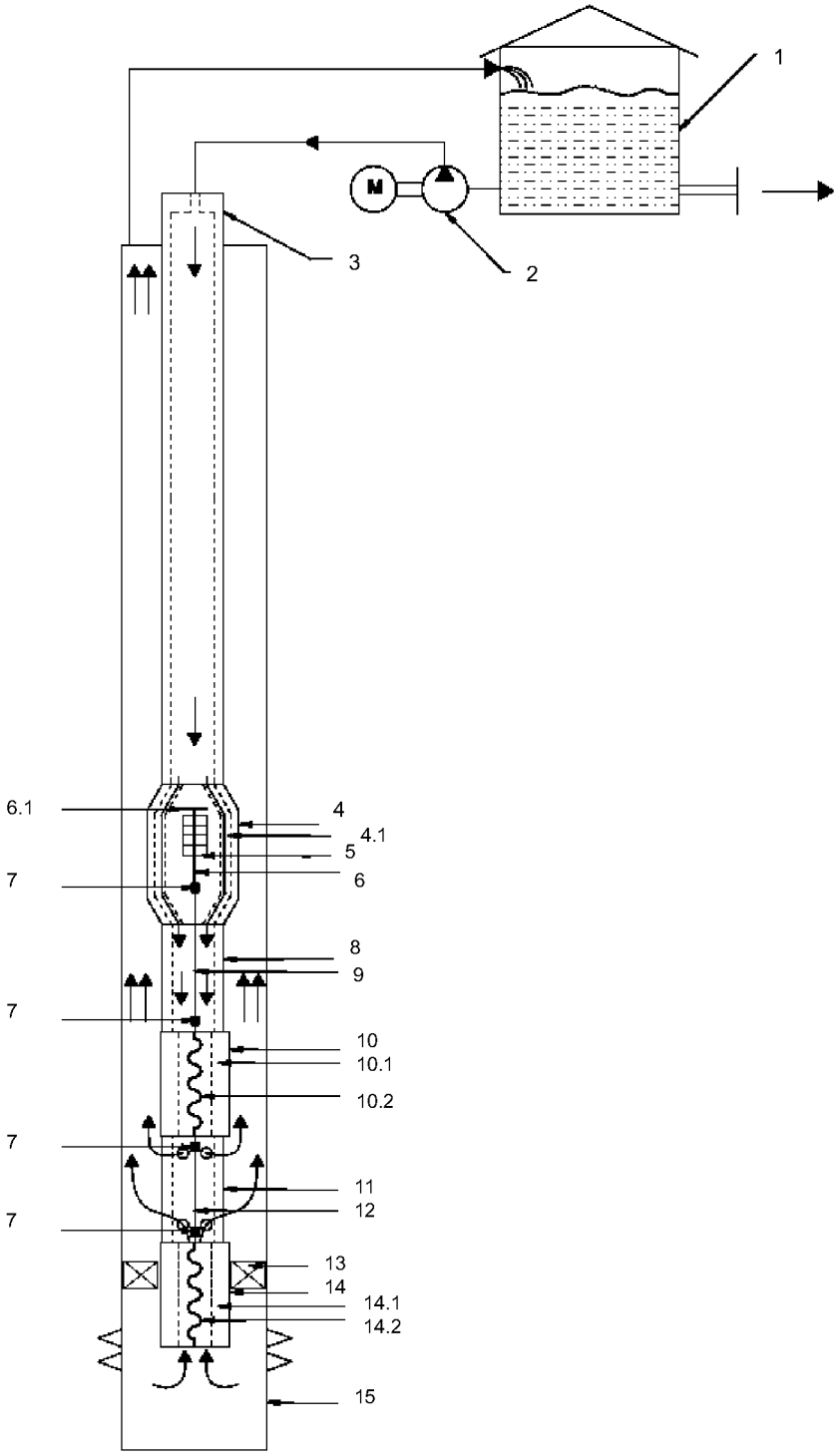
FIG. 1. Schematic view of the artificial lifting system with progressive cavity motor in the bottom of the well for oil extraction.

1. STORAGE TANK.
2. FLUID INJECTION PUMP.
3. TUBING STRING.
4. AXIAL ROWLOCK.
  4.1. CIRCULAR HOLES ARRANGEMENT.
5. TAPER BEARING ASSEMBLY.
6. A MAJOR AXIS.
7. COUPLING SHAFT.
8. TUBE.
9. FIRST FLEXIBLE SHAFT.
10. PROGRESSIVE CAVITY MOTOR.
  10.1. STATOR OF PROGRESSIVE CAVITY MOTOR.
  10.2. ROTOR OF PROGRESSIVE CAVITY MOTOR.
11. PERFORATED TUBE.
12. SECOND FLEXIBLE SHAFT.
13. PACKAGING RELEASE.
14. PROGRESSIVE CAVITY PUMP.
  14.1. STATOR OF PROGRESSIVE CAVITY PUMP.
  14.2. ROTOR OF PROGRESSIVE CAVITY PUMP.
15. WELL CASING.

BEST MODE OF THE INVENTION

The current invention delivers an artificial lifting system with a progressive cavity motor in the bottom of the well for the oil extraction. These motors are driven by injected fluid (water or oil) sent from the surface. As the progressive cavity motor is in the bottom of the well, the connection between the progressive cavity motor and the progressive cavity pump is a flexible axis with a length less than 6 m. Hence, this implies that reliability of the system increases for the extraction of hydrocarbons. Besides, once the fluid traverse the progressive cavity motor, it returns to the surface, due to communicating vessels effect and a decrease in energy consumption required for the extraction of hydrocarbons is achieved.

MODE OF THE INVENTION

This invention relates to an artificial lifting system that comprises a progressive cavity motor (10) in the bottom of the well, for the hydrocarbons extraction, which generates a rotational movement, due to the flow of a fluid between a stator (10.1) and a rotor (10.2). This system comprises a storage tank of fluid (1), a pump (2) for injecting fluid, a tubing string (3), that connects the surface with an axial rowlock (4), a tube (8), a stator for a progressive cavity motor (10.1), a perforated tube (11), a stator for a progressive cavity pump (14.1), an annular seal (13), supported between the stator of the progressive cavity pump (14) and the well casing (15), a set of tapered roller bearings (5) supported in the axial rowlock (4), a main shaft (6), supported in the assembly tapered bearing (5), four couplings for shafts (7), two flexible shafts (9 and 12), a rotor (10.2) of the progressive cavity motor and a rotor (14.2) of the progressive cavity pump.

The artificial lifting system with progressive cavity motor (10) in the bottom of the well, for the extraction of hydrocarbons, consists of a storage tank (1) connected to the fluid suction pump (2) of injection. The discharge of the injection pump is connected to the upper end of the tubing string (3) and this in turn is connected at its lower end to an axial rowlock (4). This axial rowlock has an array of holes in a circular form (4.1), around the seat of the conical bearings. Within the axial bearing a taper bearing assembly (5) that supports the load of the main shaft (6) is installed. This main shaft is connected, via a coupling shaft (7), to one of the flexible shafts (9). At the same time, the other end of the flexible shaft is connected, via a coupling shaft (7), to the motor's rotor (10.2). The motor's rotor is located inside the stator (10.1) of the progressive cavity motor, which is attached to the rowlock (4) through a tube (8). Additionally, the lower end of the rotor (10.2) of the progressive cavity motor is connected, via coupling shafts (7), to the second flexible shaft (12). Likewise, the second flexible shaft is connected at its lower rotor (14.2) to the progressive cavity pump, via coupling shafts (7). The rotor (14.2) of the progressive cavity pump is installed inside the stator (14.1) of the progressive cavity pump, which supports the annular gasket (13). Finally, the lower end of the stator (10.1) of the progressive cavity motor is connected to the upper end of the stator (14.1) of the progressive cavity pump through a perforated tube (11).

Figure 2:
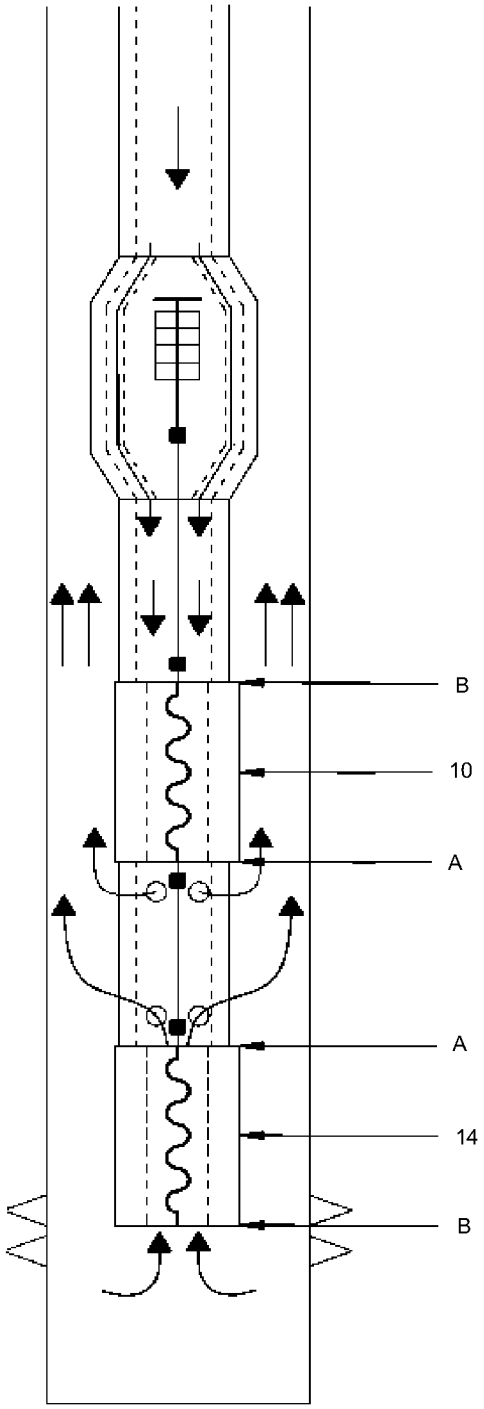
FIG. 2. Schematic detailed view of the progressive cavity motor arrangement and the progressive cavity pump, where both have the same sense of helix, but the progressive cavity motor is installed in reverse to the progressive cavity pump.

The progressive cavity motor (10) comprises a progressive cavity pump with reverse rotation to the progressive cavity pump (14). While the progressive cavity motor receives a fluid to generate a rotational movement, the progressive cavity pump receives rotational motion from the progressive cavity motor to pump the fluid. The progressive cavity motor can be a progressive cavity pump installed opposing the progressive cavity pump, as shown in FIG. 2.

Figure 3:
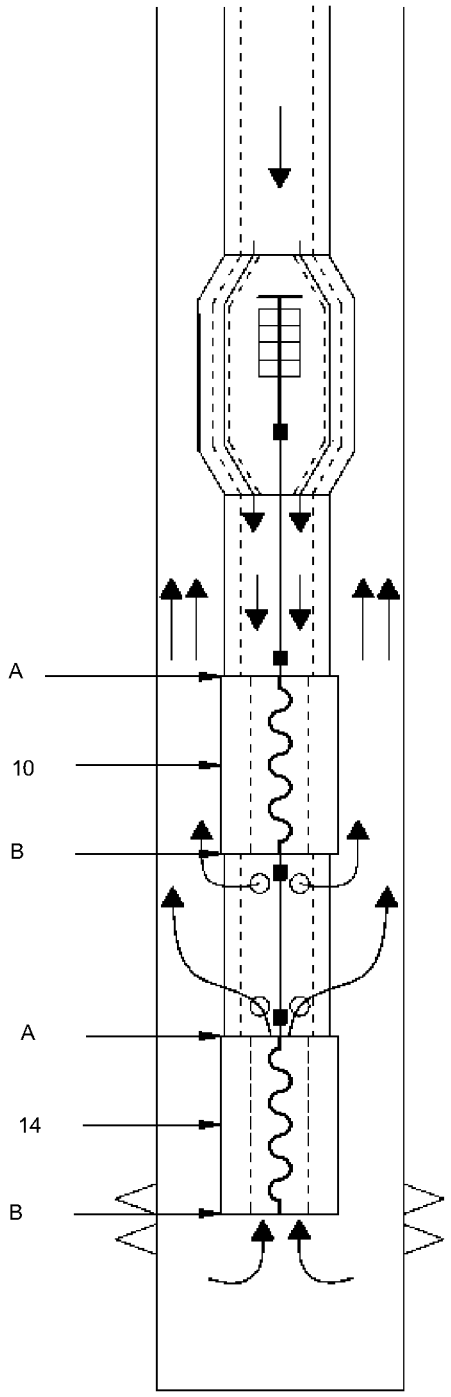
FIG. 3. Schematic detailed view of the of the progressive cavity motor arrangement and the progressive cavity pump, where the progressive cavity motor has an opposite direction to the direction of the propeller helix of the progressive cavity pump; besides the progressive cavity motor it is installed in the same direction of the progressive cavity pump.
Figure 4:
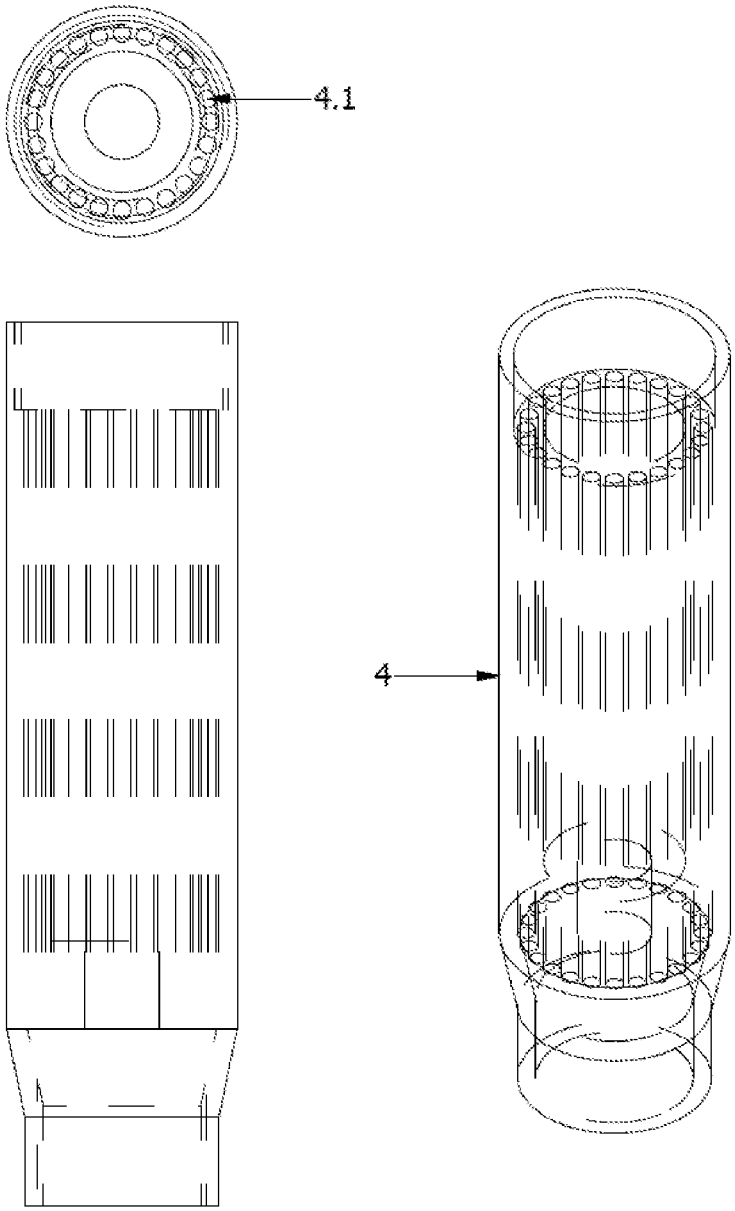
FIG. 4. Front, top and isometric views of axial rowlock (4) with visualization of the circular arrangement of holes (4.1) that allow the passage of fluid from the surface and then activate the progressive cavity motor.

The progressive cavity motor can also be a progressive cavity pump with inverse flow of the progressive cavity pump, as shown in FIG. 3.

The system consists of a pump (2) for fluid injection that sucks the fluid that is contained in the storage tank (1) and is discharged through the pipe strings (3) to the axial rowlock (4). Thus, the fluid is directed through the arrangement of the circular holes of the bearing (4.1). Subsequently, the fluid exits the axial rowlock (4) and passes through the annular space between the tube (8) and the first flexible shaft (9) towards the rotor assembly upper mouth (10.2) and stator (10.1), of the progressive cavity motor (10). Once the fluid passes between the rotor and the stator of progressive cavity motor, the rotor begins to rotate. The axial load generated by the rotational movement is transmitted to the flexible shaft (9) and from this to the main shaft (6), that comprises a shoulder (6.1) at the upper end. Thus, the main shaft rotates and is supported on the taper roller bearings (5). Finally, the fluid exits the rotor assembly (10.2) and stator (10.1) of the progressive cavity motor (10) to the lower mouth of the stator towards the outlet holes of the perforated tube (11), returning to surface through communicating vessels.

The rotational movement produced by the passage of fluid in the system is transmitted from the rotor (10.2) of the progressive cavity motor (10) to the rotor (14.2) of the progressive cavity pump (14) via the second flexible shaft (12). When the rotor (14.2) of the progressive cavity pump (14) rotates within the stator (14.1), the oil flows from the lower opening to the upper face of the stator (14.1) of the progressive cavity pump (14), and hence it passes to the outlet holes of the perforated tube (11). When the oil goes out through the perforated tube, it moves to the surface due to the discharge pressure of the progressive cavity pump (14).

INDUSTRIAL APPLICABILITY

In hydrocarbons sector it is known the use of electric or hydraulic heads in the surface as well as a bottom electric motors. Due to the bottom electric motors high speed, the artificial lifting system is only applicable in high-flow or high production wells.

The current invention delivers an artificial lifting system with a progressive cavity motor in the bottom of the well for oil extraction. These motors are driven by injected fluid (water or oil) sent from the surface. As the progressive cavity motor is in the bottom of the well, the connection between the progressive cavity motor and the progressive cavity pump is a flexible axis with a length less than 6 m. Hence, this implies that reliability of the system increases for the extraction of hydrocarbons. Besides, once the fluid traverse the progressive cavity motor, it returns to the surface, due to communicating vessels effect and a decrease in energy consumption required for the extraction of hydrocarbons is achieved.

The invention claimed is:

1. An hydrocarbon extraction system comprising:

a tank comprising a fluid discharge port, an oil intake port, and an oil discharge port;

a fluid pump having an input connected to said fluid discharge port;

a tubing string connected at its first end to an output of said fluid pump, wherein said fluid pump is configured to push fluid from the tank into the tubing string;

an axial rowlock connected at its input to a second end of said tubing string, said axial rowlock comprising a plurality of channels around an axial bearing assembly, wherein said plurality of channels are configured to direct fluid flow from said tubing string;

a first shaft having a first end rotatably coupled to said axial bearing assembly and extending through an output of said axial rowlock and through a solid tube, wherein the solid tube is connected at its first end to the output of the axial rowlock;

a progressive cavity motor having its input connected to a second end of the solid tube, wherein said progressive cavity motor comprises a rotor connected to a second end of the first shaft at said input of the progressive cavity motor, wherein the rotor of the progressive cavity motor is configured to be driven by fluid flowing from said axial rowlock to cause the fluid to exit at an output of the progressive cavity motor into a perforated tube, wherein the perforated tube is connected at its first end to the output of the progressive cavity motor;

a second shaft having its first end connected through the output of the progressive cavity motor to the rotor of the progressive cavity motor, wherein the second shaft extends through a second end of the perforated tube;

a progressive cavity pump having its output connected to the second end of the perforated tube, wherein said progressive cavity pump comprises a rotor connected to a second end of the second shaft at said output of the progressive cavity pump, wherein the rotor of the progressive cavity pump is configured to be driven by the rotor of the progressive cavity motor, wherein an input of the progressive cavity pump is configured to be sealed to a well casing; and one or more fluid communicating vessels coupled to said perforated tube and to said oil intake port of said tank.

2. The hydrocarbon extraction system of claim 1, wherein the input of the progressive cavity pump is connected to a source of hydrocarbons.

3. The hydrocarbon extraction system of claim 2, wherein the fluid communicating vessels is configured to discharge the hydrocarbons and the fluid into the tank.

4. The hydrocarbon extraction system of claim 1, wherein the hydrocarbons and the fluid exit the perforated tube through outlet holes on a wall of the perforated tube into the fluid communicating vessels.

5. The hydrocarbon extraction system of claim 1, wherein said progressive cavity pump is sealed to said well casing with an annular seal.

6. An hydrocarbon extraction system comprising:

a tubing string connected at its input end to a tank for receiving fluid from the tank;

an axial rowlock connected at its input to an output end of said tubing string, said axial rowlock comprising a plurality of channels around an axial bearing assembly, wherein said plurality of channels are configured to direct fluid flow from said tubing string through an output of said axial rowlock;

a first shaft having a first end rotatably coupled to said axial bearing assembly and extending through the output of said axial rowlock and through a solid tube, wherein the solid tube is connected at its first end to the output of the axial rowlock;

a progressive cavity motor having its input connected to a second end of the solid tube, wherein said progressive cavity motor comprises a rotor connected to a second end of the first shaft at said input of the progressive cavity motor, wherein the rotor of the progressive cavity motor is configured to be driven by fluid flowing from said axial rowlock to cause the fluid to exit at an output of the progressive cavity motor into a perforated tube, wherein the perforated tube is connected at its first end to the output of the progressive cavity motor;

a second shaft having its first end connected through the output of the progressive cavity motor to the rotor of the progressive cavity motor, wherein the second shaft extends through a second end of the perforated tube;

a progressive cavity pump having its output connected to the second end of the perforated tube, wherein said progressive cavity pump comprises a rotor connected to a second end of the second shaft at said output of the progressive cavity pump, wherein the rotor of the progressive cavity pump is configured to be driven by the rotor of the progressive cavity motor, wherein an input of the progressive cavity pump is configured to be sealed to a well casing; and one or more fluid communicating vessels coupled to said perforated tube and configured to return the fluid to said tank.

7. The hydrocarbon extraction system of claim 6, wherein the input of the progressive cavity pump is connected to a source of hydrocarbons.

8. The hydrocarbon extraction system of claim 7, wherein the fluid communicating vessels discharge the hydrocarbons and fluid into the tank.

9. The hydrocarbon extraction system of claim 6, wherein the hydrocarbons and the fluid exit the perforated tube through outlet holes on a wall of the perforated tube into the fluid communicating vessels.

10. The hydrocarbon extraction system of claim 6, wherein said progressive cavity pump is sealed to said well casing with an annular seal.

* * * * *